United States Patent [19]

Bouchet

[11] Patent Number: 4,729,178

[45] Date of Patent: Mar. 8, 1988

[54] ANTIWEAR AND NONSKID PROTECTIVE ELEMENT FOR A SHOE HEEL

[75] Inventor: Manoel Bouchet, Montagny-les-Beaune, France

[73] Assignee: Ste Manoel Bouchet SA, Ladoix-Serrigny, France

[21] Appl. No.: 885,806

[22] Filed: Jul. 15, 1986

[30] Foreign Application Priority Data

Jul. 23, 1985 [FR] France ..... 85 11216

[51] Int. Cl.[4] ..... A43B 21/42; A43B 21/00

[52] U.S. Cl. ..... 36/35 A; 36/34 R

[58] Field of Search ..... 36/42, 36 R, 36 C, 36 A, 36/71.5, 34 R, 35 R, 35 A, 34 A, 36 B

[56] References Cited

U.S. PATENT DOCUMENTS

| | | | |
|---|---|---|---|
| 1,861,118 | 5/1932 | Gilowitz | 36/34 R |
| 1,952,330 | 3/1934 | Miller et al. | 36/34 A |
| 2,932,098 | 4/1960 | Lange | 36/34 R |
| 2,935,799 | 5/1960 | Ronoi | 36/42 |
| 4,403,426 | 9/1983 | Kaplan | 36/36 R |

FOREIGN PATENT DOCUMENTS

| | | | |
|---|---|---|---|
| 1253136 | 12/1960 | France | 36/34 R |
| 75535 | 5/1961 | France | 36/34 R |
| 1266992 | 6/1961 | France | 36/34 R |
| 79190 | 9/1962 | France | 36/34 R |
| 1464051 | 12/1966 | France | 36/42 |
| 579841 | 8/1958 | Italy | 36/36 R |
| 668034 | 9/1964 | Italy | 36/34 R |
| 915312 | 1/1963 | United Kingdom | 36/34 R |
| 2059744 | 4/1981 | United Kingdom | 36/34 R |

*Primary Examiner*—Steven N. Meyers

*Attorney, Agent, or Firm*—Browdy and Neimark

[57] ABSTRACT

An antiwear and nonskid protective element for a shoe heel, which comprises an outside first part in which a through opening is made the surface of the cross section of which is greater on the side in contact with the heel of the shoe than on the side of its free end; and a second part comprising a head, whose shape and dimensions correspond approximately to those of said opening, and a rod provided with a rigid inside reinforcement, the rod being able to be driven with force into a hole made in the heel for the fastening of the element. Thus, an effective and reliable fastening of the element to the free end of the heel.

9 Claims, 2 Drawing Figures

Fig. 1
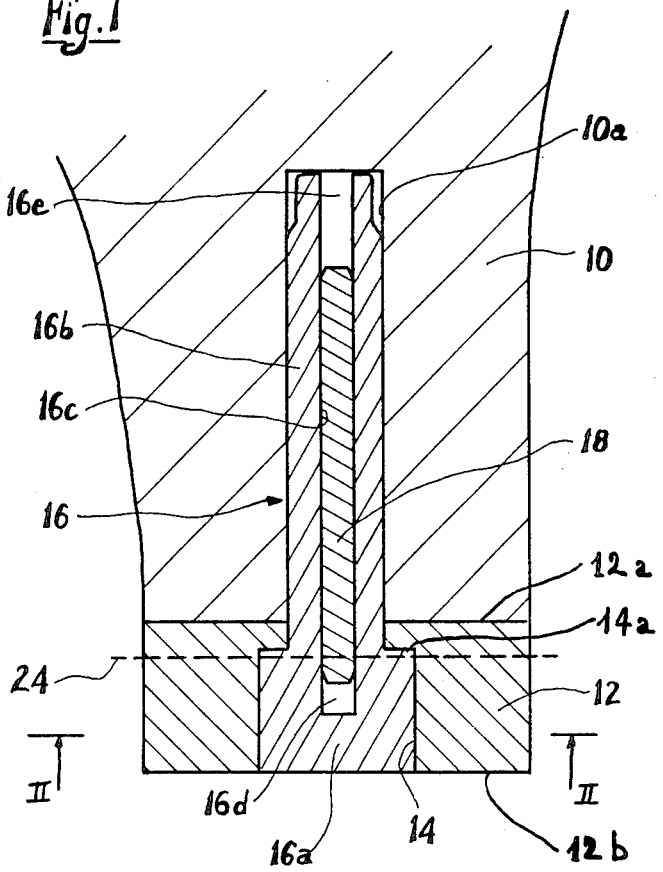
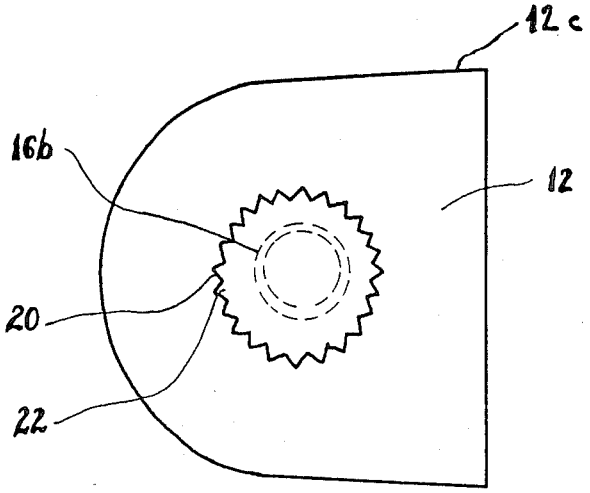
Fig. 2

ANTIWEAR AND NONSKID PROTECTIVE ELEMENT FOR A SHOE HEEL

FIELD OF INVENTION

This invention relates to the field of shoemaking, in particular the manufacture and repair of shoes. More specifically, it relates to a new antiwear and nonskid protective element fastened to the end of the heel of a shoe, particularly of a woman's show having a thin heel.

BACKGROUND OF THE INVENTION

Several types of these elements, often designated by the term "bonbout," are already known in the field. These elements are conventionally intended mainly to give the heel a nonskid feature, and to substitute direct wear of the heel caused during walking with a wear of this element which can be easily replaced. The most known type of element consists of a simple block of wear-resistant synthetic plastic which is somewhat resilient which is fastened to the end of the heel of a shoe with a metal fastening element such as a pin, a peg, a nail, etc., driven into said end. To prevent the head of the metal fastening element from rubbing the ground when walking, it is known to provide in the wear block a suitable reinforcement intended to receive said head, so that it cannot come in contact with the ground. However, as soon as a certain wear of the block has occurred, it is designed so that the head of the fastening element is flush with its lower surface. This can damage the ground and/or cause untimely noises.

To eliminate this drawback, it has been provided to bury the head of the fastening nail inside the protective element. This solution, however, leads to another drawback. Actually, because of the inherent flexibility of the material of the element, it is understood that fastening it to the end of the heel with a hammer does not result in the perfectly rigid assembly that is desired, and frequently this type of element has to be replaced long before its degree of wear makes it necessary, for example because of a premature separation of the assembly due to a misstep, an accidental impact, or also because of a marked phenomenon of punching of the protective element by the nail head that it is covering.

Finally, it is often found after a certain time of use, particularly with narrow heels, such as spike heels or the like, that the protective element can freely turn in relation to the heel. This is certainly disadvantageous, both from the viewpoint of the stability and comfort of the shoe and the esthetic viewpoint.

The solution to this specific problem which consists in fastening the protective element with a plurality of nails is not always possible, in particular because of the above-mentioned narrowness of the heel.

Moreover, a drawback of all the elements resides in the fact that their centering at the end of the heel is often delicate and imprecise.

In French patent application No. 84 18805 of the same applicant, a two-part element is disclosed, the inside part of the element keepng the outside part in place and being fastened by a nail. However, the sturdiness of this type of assembly can still be improved.

SUMMARY OF THE INVENTION

This invention has as its object to eliminate all these drawbacks and to propose an antiwear and nonskid protective element for a shoe heel whose fastening exhibits a good sturdiness during use, while being simple to achieve. Another object of the invention is to propose a protective element in which no punching is exerted on the element by the head of the fastening nail, and which eliminates the risks of resonance and slipping of the fastening.

For this purpose, this invention relates to an antiwear and nonskid protective element for a shoe heel characterized in that it comprises an outside first part in which a through opening is made the cross section surface of which is greater on the side in contact with the heel of the shoe than on the side of its free end; and a second part comprising a head whose shape and dimensions correspond approximately to those of said opening, and a rod provided with a rigid inside reinforcement, the rod being able to be driven with force into a hole made in the heel for the fastening of the element.

DESCRIPTION OF THE DRAWINGS

The invention will be better understood after reading the following detailed description of a preferred embodiment of it, given by way of example and made with reference to the accompanying drawing in which:

FIG. 1 is an elevation in section of a protective element according to the invention, mounted on a heel, and FIG. 2 is a view from below in section along line II—II of FIG. 1.

With reference to the drawing, the lower region of a shoe heel 10 has been represented (FIG. 1). According to the invention, an antiwear and nonskid protective element for the lower end of heel 10 comprises an outside first part 12, of a relatively strong material, such as metal or a plastic of suitable hardness. First part 12 exhibits the shape of a block having an upper face **12*a* and a lower face 12*b* parallel to one another, and an outside profile 12*c* (FIG. 2) whose shape can be adapted to the outside shape of heel 10**.

Between faces **12*a* and 12*b* of part 12 there extends a through opening 14. In this example, opening 14 exhibits a step 14*a* separating two cylindrical sections of different diameters, the section with the smallest diameter being on the side of the heel. Of course, opening 14 can also be in the form of a taper or the like, the condition being that its cross section surface is smaller on the side of heel 10** than on the side of its free end.

The protective element according to the invention further comprises a second lower part 16. Part 16 consists of a head **16*a* whose shape and dimensions correspond approximately to those of opening 14, and arranged to be received closely inside said opening. Part 16 further comprises a rod 16*b* which extends approximately vertically upward from the upper surface of head 16*a*. Head 16*a* and rod 16*b* are made of the same material and are unitary. A longitudinal bore 16*c* is made in rod 16*b*. Bore 16*c*** is open at the free end of the rod, but ends on the side of the head while being slightly extended inside it, without however going through it.

In bore **16*c* is received a reinforcement element in the form of a rigid rod 18, of a metal or a suitable plastic. The length of reinforcement 18 is selected slightly less than that of bore 16*c*, so as to leave two free spaces, 16*d* and 16*e*** respectively, at its two ends, for purposes explained below.

Moreover, and in particular as FIG. 2 shows, parts 12 and 16 are made solid in rotation, during their assembly by a plurality of additional striae or ribs 20, 22 provided respectively on the mutual contact faces of these parts 12 and 16. Triangular-shaped striae have been shown in the example. Of course, this shape is not limiting.

Further, in this example, parts 12 and 16 are made of different materials, the resistance to wear of lower part 12 being selected superior because this latter has a tendency to wear more quickly than upper part 16. Preferably, suitable synthetic plastics will be used for parts 12 and 16. Rigid reinforcement 18, for its part, can be made of steel wire or the like.

In a suitable manner, part 16 of the protective element will be made by duplicate-molding around rigid reinforcement 18.

The assembly of the antiwear and nonskid protective element as described above can be done by first placing outside part 12 at the end of heel 10 so that it extends in the extension of said end, then by nailing inside part 16 provided with its reinforcement 18 after having inserted it into opening 14. Rod 16*b* and its reinforcement 18 are simultaneously driven into a hole 10*a* of heel 10, until the lower faces of parts 12, 16 extend approximately in the same plane.

It is understood that outside part 12 is thus firmly immobilized, thanks both to the stepped shape of the surfaces in contact with parts 12 and 16 and to additional striae 20, 22 that these surfaces carry. Moreover, the hold with compression of rod 16*b* between rigid reinforcement 18 and the material of heel 10 prevents any undesirable rotation of parts 12, 16 that are made solid with one another. Also to promote this immobilization, longitudinal ribs or the like, for instance striae such as shown in FIG. 2 for the contact surfaces of parts 12 and 16, can be provided on the outside surface of rod 16*b*.

Moreover, it should be noted that the design of the element of the invention makes possible a completely easy and exact centering of it at the end of the heel, thanks to the presence of outside part 12 which takes the place of a guide during the fastening.

Finally, the fact that reinforcement 18 does not occupy the entire length of bore 16*c* makes it possible for said reinforcement to be retracted in upper free space 16*e*, thus advantageously to avoid any deformation of it when wear on the bottom of the heel allows a thrust on reinforcement 18, and this up to a maximum wear line, (indicated by 24 in FIG. 1).

Of course, this invention is not limited to the embodiment described, but it includes any variant or modification that a person skilled in the art could bring to it.

I claim:

1. An antiwear and nonskid protective element for a shoe heel comprising:
   - a first part in which a through opening is made, the opening being smaller on a side in contact with a heel part of the shoe than on a free end opposite thereto;
   - a second part comprising a head, the shape and dimensions of which correspond to those of said opening, and a rod provided with a rigid inside reinforcement, the rod being capable of being driven with force into a hole made in the heel part for the fastening of the element, said rod having a bore extending longitudinally therein; and
   - a reinforcement inserted in said bore of said rod and being axially movable therein responsive to wearing of said free end of said first part and of said head of said second part.

2. Element according to claim 1, wherein the second part is of plastic and is made by duplicate molding around said reinforcement.

3. Element according to claim 2 wherein the through opening is stepped.

4. Element according to claim 2 wherein the inside surface of the opening and the outside surface of the head of the second element carry additional male/-female cooperation means.

5. Element according to claim 2 wherein the rod of the second part of the element carries longitudinal ribs on its outside surface.

6. Element according to claim 2 wherein the reinforcement is made of steel wire.

7. Element according to claim 1 wherein the inside surface of the opening and the outside surface of the head of the second element carry additional male/-female cooperation means.

8. Element according to claim 1 wherein the rod of the second part of the element carries longitudinal ribs on its outside surface.

9. A shoe heel including the protective element of claim 1, comprising said antiwear and nonskid protective element provided on an end of said heel part,
   - said heel part having said hole therein extending upward for insertion of said reinforcement from a top part of said heel part into said bore of said rod.

* * * * *